United States Patent [19]

Ross et al.

[11] Patent Number: 4,834,175

[45] Date of Patent: May 30, 1989

[54] HYDRAULIC VERSA-TRIEVE PACKER

[75] Inventors: Colby M. Ross; Pat M. White, both of Carrollton, Tex.

[73] Assignee: Otis Engineering Corporation, Carrollton, Tex.

[21] Appl. No.: 245,654

[22] Filed: Sep. 15, 1988

[51] Int. Cl.[4] ..... E21B 33/128; E21B 33/129

[52] U.S. Cl. ..... 166/120; 166/187

[58] Field of Search ..... 166/120, 122, 187, 196, 166/387

[56] References Cited

U.S. PATENT DOCUMENTS

| | | | |
|---|---|---|---|
| 3,122,205 | 2/1964 | Brown et al. | 166/122 |
| 3,215,205 | 11/1965 | Sizer | 166/120 |
| 3,215,207 | 11/1965 | Sizer | 166/122 |
| 3,398,795 | 8/1968 | Elliston | 166/120 |
| 3,987,854 | 10/1976 | Callihan et al. | 166/278 |
| 4,018,272 | 4/1977 | Brown et al. | 166/119 |
| 4,044,826 | 8/1977 | Crowe | 166/120 |
| 4,180,132 | 12/1979 | Young | 166/120 |
| 4,224,987 | 9/1980 | Allen | 166/120 |
| 4,345,649 | 8/1982 | Baugh et al. | 166/120 |
| 4,438,811 | 3/1984 | Patel | 166/123 |
| 4,441,553 | 4/1984 | Setterberg, Jr. et al. | 166/138 |
| 4,516,634 | 5/1985 | Pitts | 166/120 |
| 4,671,354 | 6/1987 | Henderson et al. | 166/134 |
| 4,688,634 | 8/1987 | Lustig et al. | 166/120 |

*Primary Examiner*—Stephen J. Novosad
*Attorney, Agent, or Firm*—Dennis T. Griggs

[57] ABSTRACT

A hydraulic well packer for releasable setting within a well casing is disclosed. The packer includes a hydraulic actuator assembly mounted between annular packing seal elements and anchor slips, with the seal elements, hydraulic actuator assembly and anchor slips being mounted for sliding movement along the packer mandrel. Premature retraction of the setting cylinder relative to the piston is prevented by interlocking action of a shear screw lock and a transfer lug against the piston, setting cylinder and a tubular setting wedge. The piston is locked against the anchor slips and the slip housing so that seals mounted on the piston head which engage the mandrel and the setting cylinder cannot be dragged and worn out prematurely in response to hydraulic pressure fluctuations imposed after the packer has been set and sealed. The setting piston and setting cylinder are locked together during run-in by the shear screw and by interlocking engagement of the transfer lug. The transfer lug is shifted to provide a direct interlocking engagement between the setting piston and the setting wedge assembly after hydraulic pressurization has been initiated to a level sufficient to cause separation of the shear screw. According to this arrangement, the shear screw lock is substantially isolated with respect to the weight of the well packer and any production equipment connected to the packer and can only be sheared in response to the application of a hydraulic setting force developed by introduction of hydraulic pressure through a tubing string.

12 Claims, 3 Drawing Sheets

FIG. 1A (RUN-IN)

FIG. 2A (SET)

FIG. 3A (RELEASE)

HYDRAULIC VERSA-TRIEVE PACKER

FIELD OF THE INVENTION

The present invention relates generally to petroleum production equipment, and in particular to hydraulic actuated, retrievable well packers for securely sealing the annulus between a tubing string and the bore of a surrounding well casing.

BACKGROUND OF THE INVENTION

In the course of treating and preparing subterranean oil and gas wells for production, a well packer along with a production seal unit are run into the well on a work string, with the packer being set against a casing bore. During run-in, the packer is mechanically locked in the unset condition by shear pins. The shear pins support the weight of the packer along with the hang weight of other components such as a swivel shear sub, blank pipe, sand screen, polished nipple, tail screen, sealing unit and sump packer. The shear pins safely support the combined weight of the downhole equipment, and are rated to yield to a preset shearing force to separate and release the production seal unit after the packer has been set. The packer may be set in the sealing/anchoring configuration by application of hydraulic pressure applied through the work string. The packer may be released from the set configuration and retrieved from the well by appropriate manipulation of the tubing string and a specially designed releasing tool.

The purpose of a packer is to support production tubing and equipment such as a screen or safety valve adjacent to a producing formation and to seal the annulus between the outside of the production tubing and the inside of the well casing to prevent movement of fluids through the annulus past that location. The packer is provided with slip anchor members having opposed camming surfaces which cooperate with complementary opposed wedging surfaces, whereby the slip anchor members are extendable radially into gripping engagement against the well casing bore in response to relative axial movement of the wedging surfaces. The packer also carries annular resilient seal elements which expand radially into sealing engagement against the bore of the well casing in response to axial compression forces. Longitudinal movement of the packer components which set the anchor slips and the sealing elements ma be effected either hydraulically or mechanically.

DESCRIPTION OF THE PRIOR ART

After the packer has been set and sealed against the well casing bore, it should maintain sealing engagement upon removal of the hydraulic or mechanical setting force. Moreover, it is essential that the packer remain locked in its set and engaged configuration while withstanding variation of hydraulic pressures applied externally or internally from the formation and/or manipulation of the tubing string and service tools without unsetting the packer. On the other hand, it is desirable that the packer be retrievable from the well by appropriate manipulation of the tubing string to cause the packer to be released and unsealed from the well bore. In some arrangements, the packer may be released from set engagement by a straight pull upwardly on the work string.

In some packer assemblies, the sealing elements and anchoring slips are fixed in a set configuration by a pressure responsive locking device. Such clamping or holding devices limit longitudinal movement of the setting components which might otherwise release the packer prematurely. Such unwanted longitudinal movement may be induced by a variation in tubing string length due to temperature variations, by an increase in downhole fluid pressure acting upwardly on the tubing string, or by surge forces applied across the packer during pressure testing.

In hydraulically actuated packers, the setting piston is constantly exposed to such pressure fluctuations. The annular piston seals are subjected to buffeting surge forces which are transmitted through the setting cylinder or other hydraulic pressure responsive setting tool. As a result of such buffeting forces, the annular piston seal elements may become prematurely worn and leak. A leaky piston may in some instances, where the piston is mounted above the packer seal elements, interrupt the sealing engagement between the packer and the surrounding well casing bore. If sealing engagement is impaired or destroyed, it may be difficult or impossible to restore the sealed connection between the tubing string and the well bore.

In some packer assemblies, the annular sealing elements are mounted onto a separate mandrel which is fitted about the main packer mandrel in an arrangement which minimizes the transmission of mechanical forces which act to unset the anchoring engagement or interrupt the sealing engagement between the sealing elements and the well bore. In prior art hydraulically actuated pistons having a separate mandrel, the piston is located above the sealing elements, with the hydraulic force developed by the piston being applied first to compress the annular sealing elements. As a result, a reduced level of force remains available for setting the anchor slips. Another limitation of the arrangement in which the annular sealing elements are interposed between the setting piston and the anchor slips is the requirement of elaborate piston seals to avoid leakage.

Other prior art packers have included setting apparatus with shear pins which provide both weight supporting functions and packer setting sequence control. Under certain operating conditions, premature shearing of the pins can occur as a result of the starting and stopping of the tubing string while making up pipe as the string is run into the well, which cause impact forces which may shear the pins. Occasionally, the packer and running tool may encounter obstructions as the tubing string is lowered through the well bore. Where shear pins are the primary connection between the packer and the running tool, frictional engagement between the packer and the well bore in a deviated well can cause the pins to be sheared prematurely.

Another limitation of the use of shear pins as the primary connection between the packer and the running tool is that after the pins have been sheared, upward and downward forces cannot be applied to the packer to determine if the packer is properly set and to pressure test the packer.

OBJECTS OF THE INVENTION

Accordingly, it is the principal object of the present invention to provide a packer which can be set and locked in sealing engagement within a well bore, in which an annular setting piston is locked against displacement after the packer sealing elements and anchor slips have been set and sealed against the well bore.

A related object of the invention is to provide an improved hydraulic packer in which the setting piston is locked to avoid premature wear caused by hydraulic pressure surges after the packer has been set and sealed.

Another object of the invention is to provide an improved hydraulic packer which can be run and set in a single trip in a well bore and which can be set hydraulically during that run.

Another object of the invention is to provide an improved hydraulic packer in which the force developed by the actuating piston can be applied equally to set the annular seals and the anchor slips.

A related object of this invention is to provide an improved hydraulic packer in which the piston setting mechanism is positioned between the expandable sealing elements and the anchor slips.

Yet another object of the invention is to provide an improved hydraulic packer in which the sealing elements and anchor slips are mounted directly onto the packer mandrel in an arrangement that does not employ a separate mandrel.

Another object of this invention is to provide a hydraulic packer in which the number and size of seals required to seal the actuating piston are reduced.

Another object of this invention is to provide a hydraulic packer having a shearable lock which prevents premature setting of the packer and which is mechanically decoupled with respect to handling forces applied through the tubing string and service tool.

A related object of the invention is to provide an improved hydraulic well packer having a shear screw lock for preventing packer presetting, in which the shear screw lock is substantially isolated with respect to the weight of the well packer and any production equipment connected to the packer, and which can only be sheared in response to the application of a hydraulic setting force developed by introduction of hydraulic pressure through the tubing string.

SUMMARY OF THE INVENTION

The foregoing objects are achieved according to a preferred embodiment of the present invention in which a hydraulic packer has a hydraulic actuator assembly mounted between annular packing seal elements and anchor slips. In the preferred embodiment, the annular packing seal elements, hydraulic actuator assembly and anchor slips are mounted directly for sliding movement along the packer mandrel. Equal setting forces are applied to the annular seal elements and the anchor slips by an annular setting cylinder which is mounted for slideable sealing engagement against the packer mandrel, and by an annular piston which is sealed against the packer mandrel and against the bore of the setting cylinder.

The hydraulic force applied against the piston is transmitted to the anchor slips through a tubular wedge which is initially locked to the piston by a shear screw. Additionally, the setting cylinder is mechanically restrained from extension by the blocking engagement of a transfer lug supported on the tubular wedge. According to this arrangement, the shear screw is decoupled with respect to mechanical impact forces transmitted through the packer mandrel, and the setting cylinder and tubular wedge are locked against relative movement to prevent premature setting the packer prior to application of hydraulic pressure.

Upon application of hydraulic pressure into the pressure chamber within the setting cylinder, the pressure forces are increased until the shear strength of the shear screw is overcome. As the shear screw shears, the setting cylinder is released and extends against the annular packing seal, while the piston drives the top wedge into engagement with the anchor slips.

According to an important feature of the invention, as the setting cylinder extends into engagement with the annular packing seal, and the annular piston is driven toward the tubular top wedge, the transfer lug is driven by the setting cylinder into an annular slot formed about the neck of the piston. When the transfer lug falls into the annular slot, the piston and slip setting wedge become mechanically linked together for concurrent movement and cannot thereafter be displaced axially with respect to each other. According to this arrangement, the setting cylinder can continue to move independently of the piston in response to the application of hydraulic pressure within the pressure chamber. Because the head of the setting cylinder has the same surface area as the head of the piston, equal but opposite setting forces are applied against the annular packing seal and the anchor slips, respectively.

Retraction of the setting cylinder relative to the piston is prevented, in the preferred embodiment, by the interlocking engagement of the transfer lug between the piston and the tubular wedge, and by a ratchet slip which is interposed between the tubular wedge and a slip housing cylinder which is attached to the setting cylinder. That is, the ratchet slip permits extension movement of the setting cylinder relative to the piston and tubular wedge, but its teeth are oriented for biting engagement into the slip housing bore in response to retraction movement. The advantage of this arrangement is that the piston is locked against the anchor slips and the slip housing so that the seals mounted on the piston head which engage the mandrel and the setting cylinder cannot be dragged against the mandrel and setting cylinder bore and worn out prematurely in response to hydraulic pressure fluctuations imposed after the sealing elements and anchor slips have been set and sealed against the well casing bore.

The novel features of the invention are set forth with particularity in the claims. The invention will best be understood from the following description when read in conjunction with the accompanying drawings.

BRIEF DESCRIPTION OF THE DRAWINGS

FIGS. 1A, 1B and 1C taken together form a longitudinal view in quarter section of a well packer constructed according to the present invention in a configuration to be run in a tubular well casing, with FIG. 1A illustrating the upper portion of the packer, FIG. 1B illustrating the mid section of the packer and FIG. 1C illustrating the lower portion of the packer;

FIGS. 2A and 2B taken together form a longitudinal view in half section of a packer embodying the features of the present invention showing the various parts of the packer at relative positions after the packer seals and anchor slips have been extended for sealing and anchoring engagement against the bore of a well casing; and, FIGS. 3A, 3B and 3C taken together form a longitudinal view in half section of the hydraulic packer of the present invention showing the various parts of the packer at relative positions after the sealing elements and anchor slips have been retracted in preparation for retrieval of the packer from the bore of a well casing.

DETAILED DESCRIPTION OF THE PREFERRED EMBODIMENT

Figure 1B:
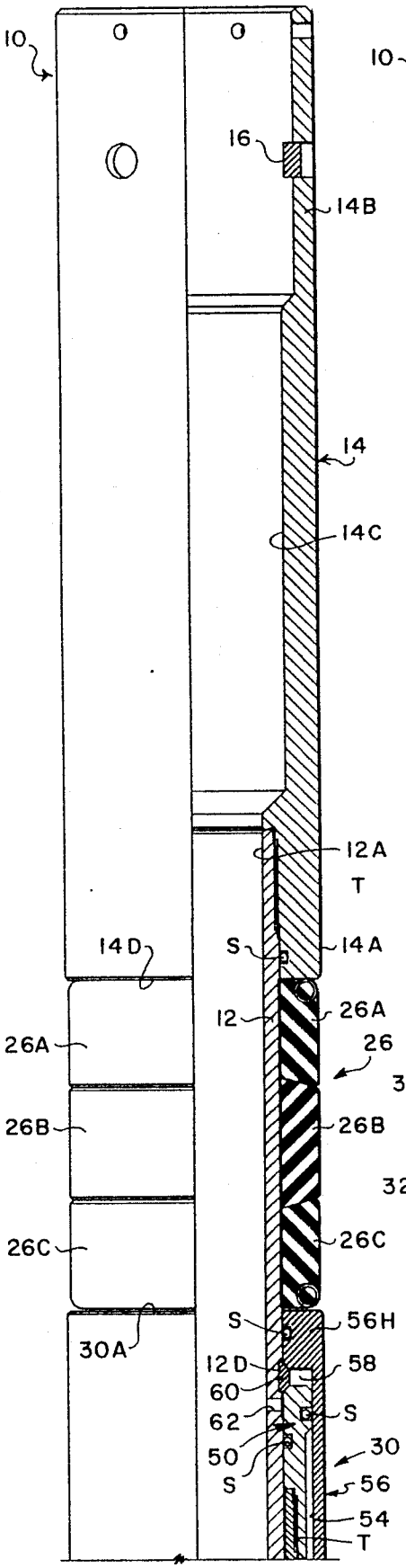
Figure 1B:
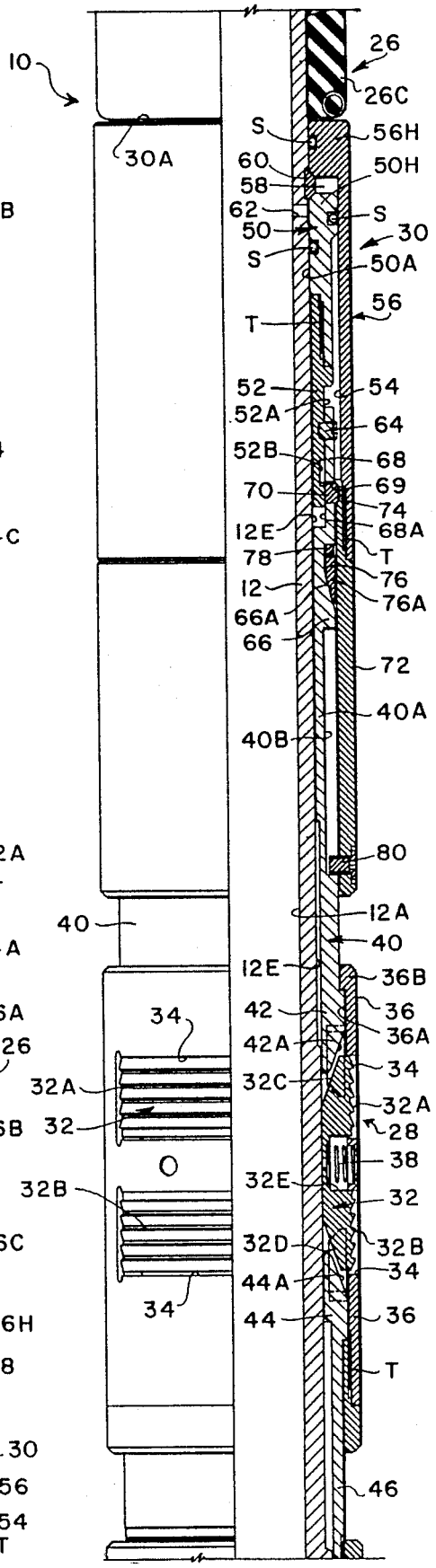

In the description which follows, like parts are marked throughout the specification and drawings with the same reference numerals, respectively. The drawings are not necessarily to scale and the proportions of certain parts have been exaggerated to better illustrate details and features of the invention. As used herein, the designation S refers to internal and external O-ring seals and the designation T refers to a threaded union.

Figure 1C:
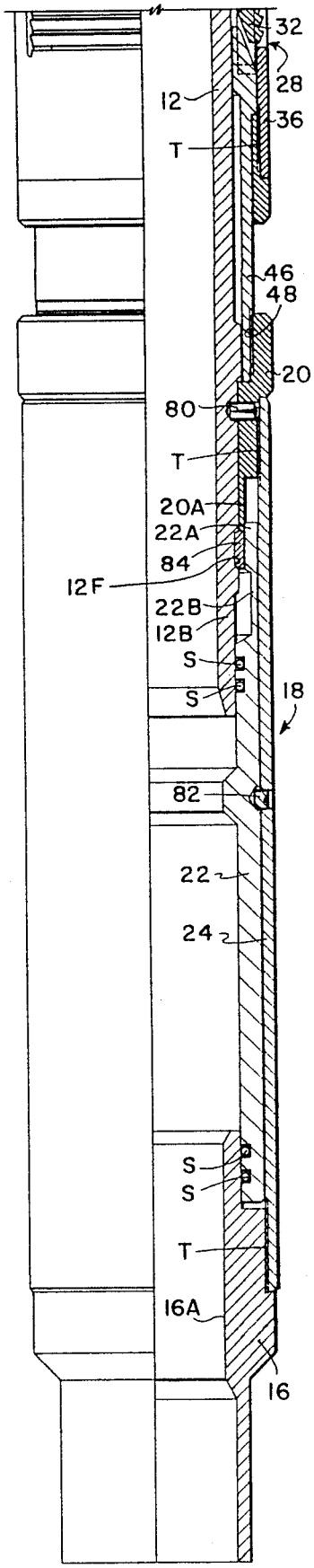

Apparatus constructed according to the present invention in the form of a hydraulic well packer 10 is shown generally in FIGS. 1A, 1B and 1C combined. The packer 10 includes a central, tubular mandrel 12 having a generally cylindrical bore 12A.

Connected to the upper section of the packer mandrel is a top sub 14 having an internally threaded box connector 14A in which an externally threaded mandrel end portion 12A is engaged in a threaded union. The top sub 14 has a J-lug coupling box 14B, a polish bore 14C and a J-lug 16 for coupling engagement with a running tool such as a production seal unit and a supporting tubing string (not illustrated) for lowering the running tool and packer into a well bore and directing hydraulic operating fluid into the packer bore 12A.

The lower end of the packer mandrel 12B is connected to a tubular bottom sub 16 by a release coupling assembly 18, a stop ring 20, a shifting sleeve 22 and a shear sleeve 24 which are interconnected to permit release and retrieval of the packer from a well bore, as discussed in further detail hereinafter. The tubing string, which may be a well production string, for example, may be attached by threaded engagement onto the bottom sub and continued below the packer within the well casing by means of additional tubing elements extended downwardly through the casing bore for supporting a sand screen, polished nipple, tail screen and sump packer, for example. The central passage of the packer bore 12A as well as the polished bore 14C and bottom sub bore 16A are concentric with and form a continuation of the tubular bore of the tubing string.

The packer 10 includes an annular packing seal assembly 26 and a slip anchoring assembly 28, both radially extendable as described hereinafter to engage the bore of a surrounding well casing. Additionally, the packer includes a hydraulic actuator assembly 30 concentrically mounted about and onto the packer mandrel 12 between the annular seal assembly 26 and the slip anchor assembly 28.

The seal assembly 26 is mounted directly onto the external surface of the packer mandrel 12 and resides between the lower connecting end shoulder 14D of the top sub and the upper annular face 30A of the hydraulic actuator assembly. The seal assembly 26 includes an upper packing end element 26A, a center packing element 26B and a lower end packing element 26C. The upper end packing element 26A is fixed against axial upward movement relative to the packer mandrel 12 by engagement against the lower annular face 14D of the top sub. The shape, number and method of mounting the seal elements included in the seal assembly 26 may be varied as known in the art while still providing a seal assembly that may be expanded radially for example to selectively engage a well bore surrounding the packer 10.

The slip anchor assembly 28 includes a plurality of slip anchors 32 which are mounted for radial movement through windows 34 formed in a tubular slip carrier 36. While the number of anchor slips 32 may be varied, the tubular slip carrier 36 is provided with an appropriate corresponding number of windows 34, with four anchor slips 32 being preferred. Each of the anchor slips 32 includes upper and lower gripping surfaces 32A, 32B, respectively, positioned to extend radially through the windows 34 with the wall of the slip carrier 36 between the paired windows confining a coil spring 38 which resides in a recess 32E of the anchor slip. The coil spring 38 biases the anchor slips 32 radially inwardly relative to the wall of the slip carrier 36, thereby maintaining the gripping surfaces 32A, 32B retracted in the absence of forces displacing the anchor slips radially outwardly. Each of the gripping surfaces 32A, 32B has horizontally oriented gripping edges which provide gripping contact in each direction of longitudinal movement of the packer 10. The gripping surfaces 32A, 32B, including the horizontal gripping edges, are radially curved to conform with the cylindrical internal surface of the well casing bore against which the slip anchor members 32A, 32B may engage.

The hydraulic actuator assembly 30 is coupled to the slip anchor assembly 28 by a tubular top wedge assembly 40 which extends between the external surface 12E of the mandrel, and the internal bore 36A of the slip carrier. The wedge assembly 40 features a spreader cone 42 which extends downwardly within the slip carrier bore 36A and fits under an inwardly directing flange 36B of the slip carrier. The spreader cone 42 and slip carrier flange 36B have mating shoulders which define the limit of axial movement of the spreader cone 42 upwardly relative to the slip carrier 36. The spreader cone 42 has a downwardly facing, frustoconical wedging surface 42A which is generally complementary to the upwardly facing, slanted upper cam surface 32C of the anchor slip 32.

A lower spreader cone 44 is positioned between the external packer mandrel surface 12E and the lower bore 36A of the slip carrier and features an upwardly facing frustoconical wedging surface 44A generally complementary to the downwardly facing cam surface 32D on the slip member 32. The lower cone 44 is connected to a tubular bottom wedge 46, which is received within an annular pocket 48 defined between the annular stop ring 20 and the external packer surface 12E. Longitudinal travel of the tubular bottom wedge 46 is limited by the stop ring 20, which reacts compression forces transmitted through the anchor slip 32 upon being engaged by the upper spreader cone 42. In the run-in position as illustrated in FIGS. 1A, 1B and 1C, the tubular bottom wedge 46 is fully retracted within the annular pocket 48, and consequently, as the top wedge assembly 40 is driven into engagement with the slip anchor 32, the anchor slip 32 is displaced radially outwardly as the spreader cones engage and slip along the sloping cam surfaces 32C, 32D, respectively. The lower cone 44 is blocked against further downward movement relative to the slip carrier by the stop ring 20.

Referring now in particular to FIG. 1B, the hydraulic actuator assembly 30 includes an annular, force transmitting setting piston 50 connected to a tubular link portion 52 by a threaded union T. The inner piston bore 50A is sealed against the external cylindrical surface 12E of the mandrel by an internal O-ring seal S. The piston 50 is mounted for slideable movement along the packer mandrel surface 12E, and is also disposed in slideable, sealing engagement against the internal cylindrical bore 54 of a force transmitting setting cylinder 56. The setting cylinder 56 has an annular head portion 56H which rides in sealing engagement against the external mandrel surface 12E, with the interface being sealed by an internal O-ring seal S. The annulus 58 between the setting cylinder bore 54 and external mandrel surface 12E defines a variable volume pressure chamber 58 for directing hydraulic pressure against the piston head 50H and setting cylinder head 56H. Longitudinal movement of the piston 50 is limited in retraction by a snap ring 60 which is received within an external annular slot 12D machined into the mandrel 12. Retraction of the setting cylinder 56 is likewise limited by engagement of the setting cylinder head 56H against the snap ring 60. Hydraulic fluid pumped down the tubing string and into the packer bore enters the pressure chamber 58 through one or more radial setting ports 62.

According to an important feature of the preferred embodiment, the piston 50 and piston link portion 52 are mechanically coupled to the top wedge assembly 40 by one or more shear pins 64. Preferably, a total of six shear pins 64, spaced in a symmetrical pattern, are utilized to provide a predetermined level of connector strength between the setting piston and the top wedge. The top wedge assembly 40 includes a tubular extension 40A which is joined to a slip receiver 66. The slip receiver 66 has a tubular link portion 68 which is radially offset from the mandrel 12. The tubular slip receiver link portion 68 has a cylindrical bore 68A in which the tubular piston link portion 52 is received in telescoping engagement. In this arrangement, the slip receiver link portion 68 rides in overlapping, surface-to-surface engagement against the external surface 52A of the piston link portion 52. The slip receiver link portion 68 is locked onto the piston link portion 52 by the shear screws 64.

The setting cylinder 56 is initially restrained from extension by the blocking engagement of a transfer lug 70 carried within a radial bore 69 formed in the tubular sidewall of the slip receiver link portion 68. A tubular slip housing 72 is connected by a threaded union T to the setting cylinder 56 and surrounds the slip receiver and bottom wedge extension 40A. The upper end of the slip housing 72 has a radial bore 74 in which the head of the lug 70 is received. According to this arrangement, the setting cylinder 56 is blocked from extension against the annular packing seal elements 26 by engagement of the slip housing against the lug 70. The setting piston 50, together with the piston extension, are likewise blocked against extension away from the snap ring 60 by the connection of the shear screw 64 onto the slip receiver extension, which is blocked by engagement of the lug 70 against the slip housing 72. The slip housing 72 and setting cylinder 56 are prevented from extension toward the anchor slips 28 by engagement of the setting cylinder head 56H against the snap ring 60. Thus, the setting piston and setting cylinder are mechanically locked against extension movement which would tend to prematurely set the packing seal elements and the anchor slips by the blocking and locking action of the snap ring, the shear screw and the transfer lug.

The slip receiver 66 has a sloping conical surface 66A defining a pocket in which an annular locking slip 76 is received. The locking slip 76 is positioned internally of the slip housing 72 and is coupled thereto by coarse, upwardly facing buttress threads 76A which engage and bite into the bore of the slip housing 72, thereby preventing downward retraction of the slip housing relative to the slip receiver 66, while permitting upward extension of the slip housing against the annular packing assembly 26. The construction and function of the locking slip 76 in relation to the sloping surface 66A of the slip receiver is similar to the construction and function of the top wedge and anchor slip engagement. The upwardly facing buttress threads 76A permit the slip housing 72 to ratchet upwardly, but downward movement of the slip housing is prevented by the wedging action and biting engagement as the locking slip 76 is urged along the sloping surface 66A of the slip receiver. The locking slip 76 is biased for wedging movement along the sloping surface 66A by a wave spring 78.

The locking action of the slip ring 76 against downward movement of the slip housing 72 relative to the slip receiver 66 prevents downward movement since such movement would cause the buttress threads to wedge the slip ring even tighter into engagement against the slip housing 72. Consequently, once the setting cylinder 56 has been driven upwardly and fully extended into compressive engagement against the annular seal elements 26, the slip housing 72 is securely locked against retraction after the hydraulic driving pressure has been removed. Alignment of the slip housing 72 during extension and retraction is provided by an anti-rotation bolt 80 which is received within a longitudinal slot 40B which is machined into the top wedge extension 40A.

Figure 2B:
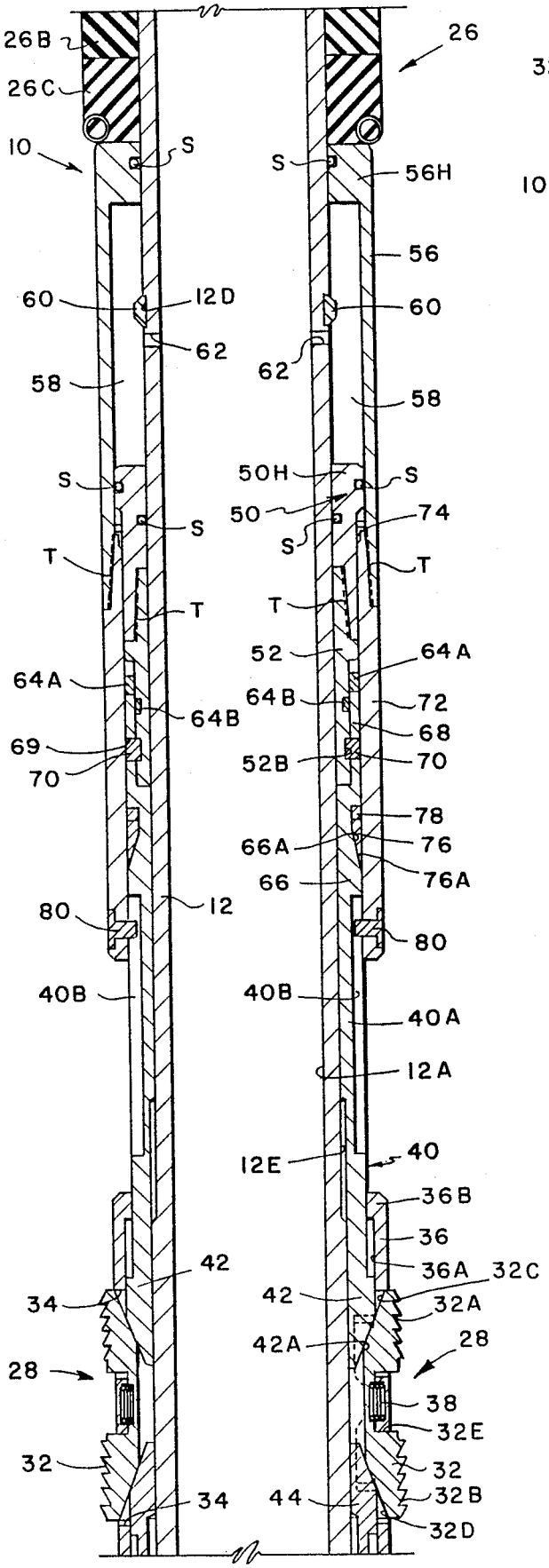
Figure 2B:
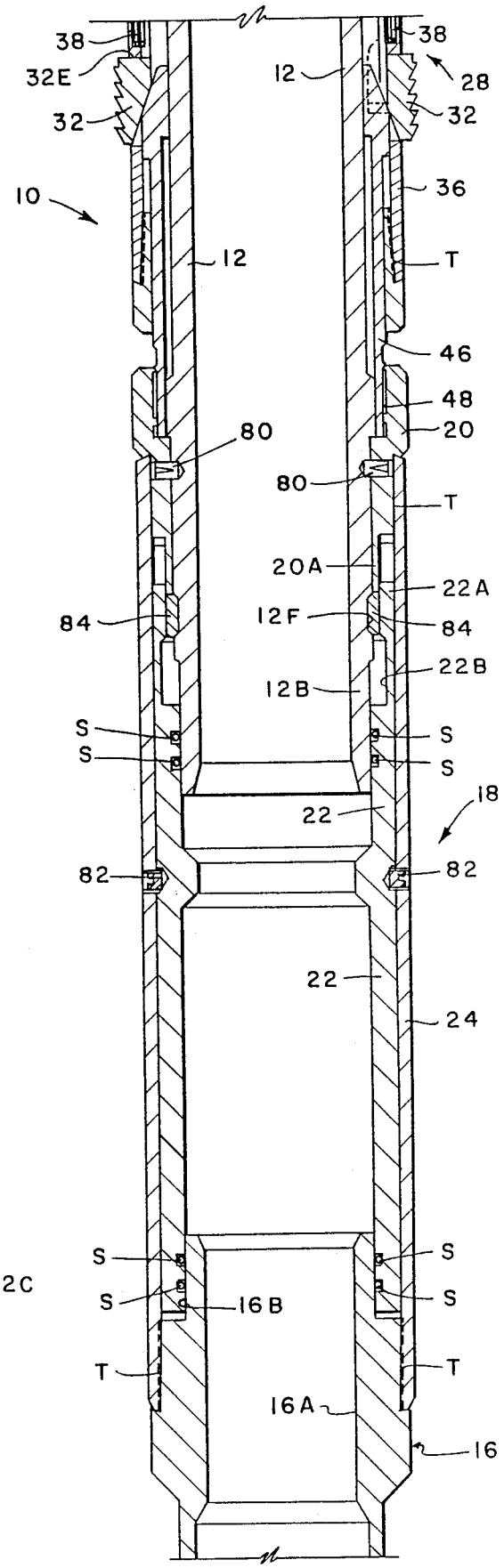

Referring now to FIGS. 2A and 2B, the packer components are shown in the fully extended, set position In the set position, the packer seal element assembly 26 is radially extended, and the anchor slips 32 are radially extended for engagement against the bore of a well casing. At the onset of extension, the shear strength of the shear screws 64 is overcome, with the result that each shear screw severs into two pieces, 64A and 64B, thereby permitting the piston link portion 52 to move downwardly relative to the slip receiver link portion 68. As the piston link portion 52 moves downwardly, the transfer lug 70 is pushed into an annular pocket 52B machined into the external surface of the tubular piston link portion 52. The transfer lug 70 is driven into the annular pocket 52B by a sloping bore surface 74 formed on the upper end of the slip housing 72.

At the same time, the extended position of the slip housing 72 is maintained by the annular ratchet slip 76. The anti-rotation bolt 80 travels along the slot 40B as the slip housing 72 is extended upwardly. The piston link portion 52 engages the slip receiver 66, and becomes mechanically coupled thereto as the transfer lug 70 is driven into the annular slot 52B. After the transfer lug 70 is loaded into the annular slot 52B, the piston and top wedge assembly become permanently linked together for concurrent movement. Upon extension of the anchor slips 32, the tubular wedge assembly 40, slip receiver 66 and piston link portion 52 become rigidly secured in place, with the result that the piston head 50H is blocked against longitudinal excursions which would otherwise be caused by hydraulic surges applied to the pressure chamber 58. The packer seal assembly 26 is also stabilized against buffeting forces by the locking action of the ratchet slip 76.

The forces of compression transmitted through the top wedge assembly 40 and slip anchor assembly 28 is reacted through the bottom wedge assembly 46 and stop ring 20. The stop ring 20 is locked onto the packer mandrel 12 by drive-lock pins 80.

Figure 3B:
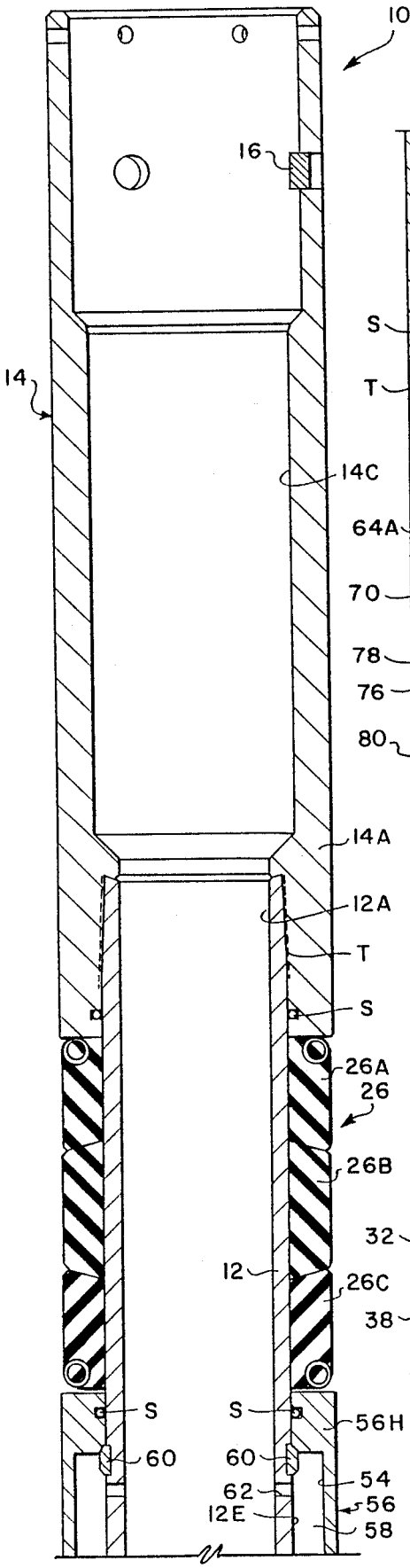
Figure 3B:
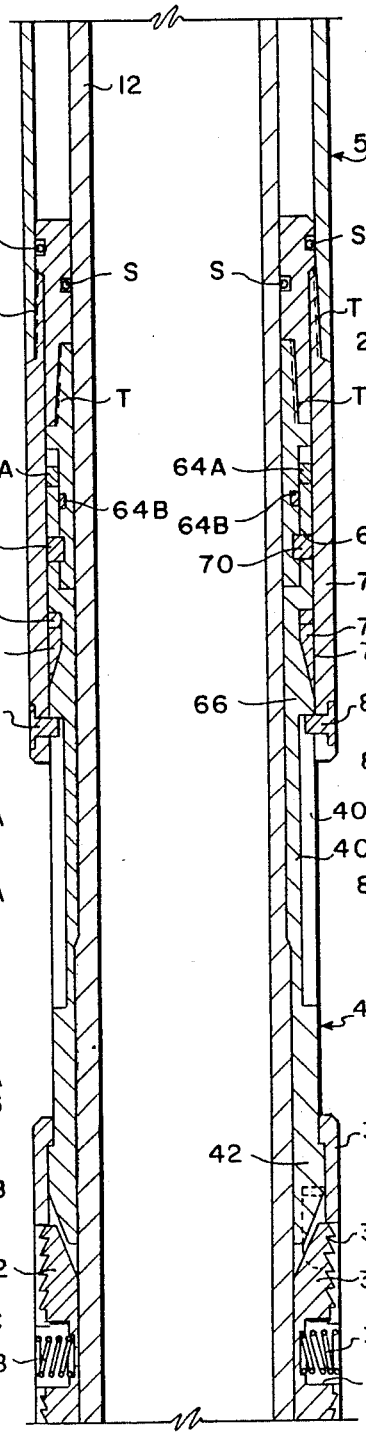
Figure 3C:
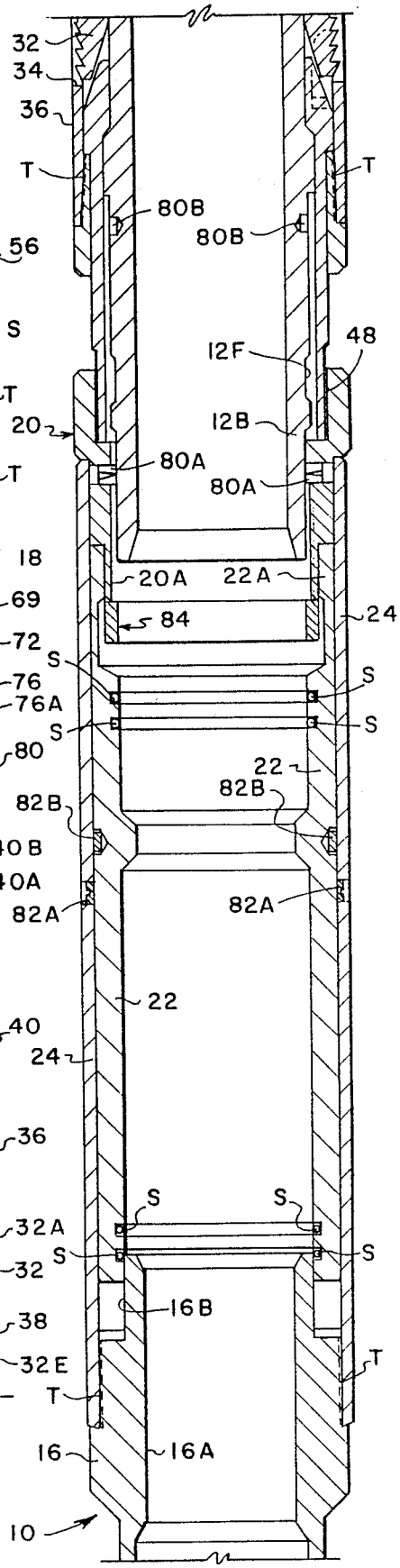

Referring now to FIGS. 3A, 3B and 3C, the relative positions of the packer components are shown upon release and radial retraction of the packer seal assembly 26 and the anchor slip assembly 28 which is accomplished to permit retrieval of the packer 10 from the well bore. In this embodiment, the packer is released from the set configuration by a straight pull of the tubing string 18 upwardly with the mandrel 12 relative to the outer packer seal assembly 26 and anchor slip assembly 28. Such relative longitudinal motion by the mandrel 12 is prevented by the hold down collar 20 which is secured by lock pins 80 to lower end 12B of the packer mandrel, and by a threaded connection to the shear sleeve 24. The shear sleeve 24 is connected at its lower end by a threaded union T onto the bottom sub 16. Additionally, the shear sleeve 24 is anchored onto the shifting sleeve 22 by a set of shear screws 82, until the hold down coupling assembly 18 is intentionally released. The shear screws 82 are sufficiently strong to prevent inadvertent relative rotational movement between the packer mandrel and the outer packer assembly 28, which might otherwise disengage a threaded connection.

After the packer 10 has been completely set, the mechanism used to plug the tubing string so that the piston chamber can be pressurized is removed. For example, a ball (not illustrated) may be dropped through the bore of the tubing string and into the service seal unit to direct flow through the setting port 62. For example, such a ball setting device may be flowed up the tubing string if the packer 10 has been set in a producing well. Otherwise, means may be provided for disposing of such a ball, or other plugging means, either up or down the well.

After the mechanical plug has been removed, the packer 10 may be released from a set configuration by a straight upward pull on the tubing string which acts through a releasing tool, through the top sub 14 and packer mandrel 12. The hold down system joining the mandrel 12 to the release coupling assembly 18 must first be unlocked. This is achieved in the initial stage of the straight pull in which the shear screws 82 are severed and separated, producing shear fragments 82A and 82B, and permitting the shifting sleeve 22 to retract longitudinally relative to the shear sleeve 24. The lower end of the shifting sleeve 22 is sealed against an external annular shoulder 16B of the bottom sub 16.

A snap ring 84 is confined within an annular slot 12F machined into the external surface of the lower end 12B of the packer mandrel. The snap ring 84 is engaged by a sleeve extension portion 20A of the hold down collar 20, and blocks extension of the hold down collar until a certain force level is applied through the packer mandrel 12 to cause separation of the shear screws 82. Upon severance of shear screws 82, the shifting sleeve 22 is free to retract longitudinally relative to the packer mandrel 12. An annular boss 22A blocks radial displacement of the snap ring 84 until it is displaced upwardly along the stop ring extension 20A. An annular slot 22B is formed internally within the shifting sleeve 22 for receiving the snap ring 84.

As the shifting sleeve 22 is retracted upwardly, the lock pins 80 are overcome and severed, the shear screws 82 are overcome and severed, and the hold down extension 20A displaces the snap ring 84 out of the mandrel slot 12F and into the shifting sleeve slot 22B, as shown in FIG. 3C. Because the lower wedge assembly 46 is connected by a threaded union onto the hold down collar 20, the lower spreader cone 44 and anchor slip 32 are retracted relative to each other, with the support provided by the camming surface 44A being removed. Likewise, the upper wedge assembly 40 is retracted along with the mandrel by the engagement of the snap ring 60 against the setting cylinder head 56H, and by engagement of the lock pin 80 against the slip receiver 66.

As the upper and lower spreader cones of 42, 44 are retracted, the anchor slips 32 are driven radially inwardly by the compression springs 38. As the mandrel 12 retracts relative to the outer hydraulic actuator assembly 30, the setting cylinder head 56A separates from the packer seal element assembly 26, thereby permitting the packer seal elements to retract radially out of engagement with the casing bore. That is, as the packer mandrel is retracted upwardly, the snap ring 60 is displaced along with it, until it engages the setting cylinder head 56H At the same time, the guide lugs 80 engage the shoulder of slip receiver 66, thereby permitting full retraction of the spreader cone 42.

It will thus be apparent that in this preferred embodiment, the annular packing seal elements 26, the hydraulic actuator assembly 30 and the anchor slip assembly 28 are mounted directly onto the packer mandrel 12. Equal setting forces are applied to the annular seal elements and the anchor slips by the annular setting cylinder and setting piston which are mounted for slideable sealing engagement against the packer mandrel at a location intermediate the sealing elements and the anchor slips. The shear screw 64 which locks the setting piston and setting cylinder together in cooperation with the transfer lug 70 are decoupled with respect to mechanical impact forces transmitted through the packer mandrel.

In the preferred embodiment, the setting cylinder and tubular wedge are locked against relative movement to prevent presetting the packer prior to application of hydraulic pressure. Because the head of the setting cylinder has the same surface area as the head of the piston, equal but opposite setting forces are applied against the annular packing elements and the anchor slips, respectively. Moreover, upon loading of the transfer lug into the annular piston slot, the piston and slip setting wedge become mechanically linked together for concurrent movement and cannot thereafter be displaced axially with respect to each other. The advantage of this arrangement is that the piston and anchor slips are locked together with the slip housing so that the seals S mounted onto the piston head cannot be dragged against the mandrel and setting cylinder bore and worn out prematurely in response to hydraulic pressure fluctuations.

The shear screw 64 and transfer lug 70 are enclosed within and shielded by the setting cylinder 56, thereby preventing inadvertent contact with well bore obstructions. Likewise, the piston and its seals are located below the main packer sealing elements 26, thereby minimizing the effect of leaky piston seals. By locating the piston below the main packer seals, the total number and size of the sealing surfaces required for an effective fluid seal are reduced.

Accordingly, the present invention provides a hydraulically set well packer which may be set and released in stages, with the packer effectively separately locked and unlocked in each of the stages of setting and release, respectively.

While a preferred embodiment of the invention has been set forth for purposes of disclosure, modification to the disclosed embodiment of the invention as well as other embodiments thereof may occur to those skilled in the art. Accordingly, the appended claims are intended to cover all embodiments of the invention and modifications to the disclosed embodiment which do not depart from the spirit and scope of the invention.

What is claimed is:

1. A hydraulic well packer comprising, in combination:

a tubular body mandrel having a longitudinal flow passage;

a seal assembly mounted onto said body mandrel;

an anchor slip assembly mounted onto said body mandrel;

a hydraulic actuator assembly mounted onto said body mandrel, said actuator assembly including first and second movable force transmitting means engagable with said seal assembly and said anchor slip assembly, respectively;

one of said force transmitting means having first and second link portions disposed in overlapping engagement with each other;

a shearable lock releasably securing said overlapping link portions together; and, a transfer lug carried by one of said link portions and engagable against said other force transmitting means in blocking relation for preventing longitudinal displacement of said first and second force transmitting means relative to each other prior to release of said shearable lock, said transfer lug being movable from said blocking position to an unblocking position relative to said other force transmitting means in response to release of said shearable lock and longitudinal displacement of said first and second link portions relative to each other.

2. A hydraulic well packer as defined in claim 1, said other link portion having a pocket for receiving said transfer lug as it moves into said unblocking position, said transfer lug interlocking said first and second link portions together in said unblocking position.

3. A hydraulic well packer as defined in claim 1, said first and second force transmitting means including an annular piston mounted for slidable, sealing engagement along said packer mandrel and a setting cylinder mounted for slidable, sealing engagement along said packer mandrel, said setting cylinder having a bore defining a pressure chamber in which said annular piston is received in slidable, sealing engagement.

4. A hydraulic well packer as defined in claim 1, said hydraulic actuator assembly being mounted onto said body mandrel between said seal assembly and said anchor slip assembly.

5. A hydraulic well packer as defined in claim 1, including a snap ring mounted onto said mandrel and projecting radially between said first and second force transmitting means, said snap ring being engagable by said first and second movable force transmitting means at the limit of extension and retraction movement thereof, respectively.

6. A hydraulic well packer as defined in claim 1, one of said force transmitting means including a tubular wedge mounted onto said mandrel body and engagable with said slip actuator assembly, and the other one of said force transmitting means having a setting head engagable with said seal assembly.

7. A hydraulic well packer as defined in claim 1, including a locking slip disposed between said first and second transmitting means, said locking slip having ratchet threads engaged against one of said force transmitting means for permitting extension movement of said first and second force transmitting means relative to each other, while preventing reversal of said extension movement.

8. A hydraulic well packer as defined in claim 1, said first and second force transmitting means comprising an annular piston mounted for slidable, sealing engagement along said packer mandrel and a setting cylinder mounted for slidable, sealing movement along said packer mandrel, respectively, said setting cylinder having a bore defining a pressure chamber in which said annular piston is received in slidable, sealing engagement, said packer mandrel having a flow port connecting the flow passage of said packer mandrel in flow communication with said pressure chamber.

9. A hydraulic well packer as defined in claim 1, including a tubular wedge mounted onto said mandrel body and engagable with said slip actuator assembly, said tubular wedge being coupled to one of said force transmitting means by said first and second link portions and by said shearable lock.

10. A hydraulic well packer as defined in claim 1, said first and second force transmitting means including an annular piston mounted for slidable, sealing engagement along said packer mandrel and a setting cylinder mounted for slidable, sealing engagement along said packer mandrel, said setting cylinder having a bore defining a pressure chamber in which said annular piston is received in slidable, sealing engagement, said first and second link portions, said shearable lock and said transfer lug being disposed within said setting cylinder bore between said packer mandrel and said setting cylinder.

11. A hydraulic well packer adapted to be set against the bore of a well casing comprising, in combination:

a body mandrel;

seal means including at least one resilient annular seal element, movable generally radially between a noninterfering retracted position to an extended configuration in which said seal means is engagable against a well casing bore;

anchoring means including a plurality of anchor slips, said anchor slips being movable generally radially between a retracted, non-interfering position and an extended position in which said anchor slips are engagable against a well casing bore;

hydraulic actuating means mounted onto said body mandrel including a setting cylinder movably mounted for slidable, sealing engagement against said body mandrel and engagable with said seal means, an annular piston movably mounted for sealing engagement against said packer mandrel and against the bore of said setting cylinder thereby defining a variable volume pressure chamber for receiving hydraulic fluid;

link means coupled to said annular piston, said setting cylinder and said anchor slip means;

first lock means releasably securing said link means to said annular piston; and, second lock means carried by said link means and engaged against said setting cylinder for preventing longitudinal displacement of said setting cylinder relative to said annular piston prior to release of said first lock means, said second lock means being movable to an unblocking position relative to said setting cylinder only upon release of said first lock means, said second lock means interlocking said link means and said annular piston together in said unblocking position.

12. In a hydraulic well packer of the kind having a seal assembly and an anchor slip assembly movably mounted onto a body mandrel for sealing the annulus between the packer and the bore of a well casing, and including a hydraulic actuator assembly movably mounted onto said body mandrel and coupled to said seal assembly and anchor assembly for extending said anchor slip assembly and said seal assembly into sealing engagement, the improvement comprising first and second tubular linking means interposed between said hydraulic actuator assembly and a selected one of said seal assembly and said anchor slip assembly, said first and second tubular link means being disposed in telescoping engagement with each other, and including a first shearable lock releasably securing said first and second link means together, and including a transfer lug carried by one of said link means and engagable with said other link means in interlocking relation only upon release of said shearable lock.

* * * * *